US005108301A

United States Patent [19]

Torok

[11] Patent Number: 5,108,301

[45] Date of Patent: Apr. 28, 1992

[54] LOCKING ELECTRICAL CORD CONNECTOR

[76] Inventor: Dale W. Torok, 1105 N. Broadway, Lexington, Ky. 40505

[21] Appl. No.: 664,456

[22] Filed: Feb. 28, 1991

Related U.S. Application Data

[63] Continuation of Ser. No. 482,075, Feb. 16, 1990, abandoned.

[51] Int. Cl.[5] ..... H01R 13/15; H01R 13/635

[52] U.S. Cl. ..... 439/263; 439/270; 439/324; 439/265; 439/651; 439/711

[58] Field of Search ..... 439/324, 347, 259, 261, 439/263, 265, 270, 140, 141, 638, 651, 711, 713, 825, 826, 262, 268, 835, 836, 843, 844, 299, 300, 628

[56] References Cited

U.S. PATENT DOCUMENTS

| | | | |
|---|---|---|---|
| 1,917,009 | 7/1933 | Betts et al. | 439/262 |
| 2,261,615 | 11/1941 | Cornwell | 439/265 |
| 2,380,908 | 7/1945 | Heller | 439/847 |
| 2,474,454 | 6/1949 | Avery | 439/259 |
| 2,716,737 | 8/1955 | Maberry | 439/176 |
| 2,799,009 | 7/1957 | Benander | 339/75 |
| 3,267,408 | 8/1966 | Baker et al. | 439/270 |
| 3,542,218 | 11/1970 | Archer | 439/266 |
| 4,544,216 | 10/1985 | Imhoff | 439/92 |
| 4,586,770 | 5/1986 | Poulin | 439/270 |
| 4,627,681 | 12/1986 | Hong | 439/263 |
| 4,693,002 | 9/1987 | Neumann et al. | 439/843 |
| 4,867,697 | 9/1989 | Borges | 439/259 |

*Primary Examiner*—Larry I. Schwartz
*Assistant Examiner*—Julie R. Daulton
*Attorney, Agent, or Firm*—King and Schickli

[57] ABSTRACT

A locking electrical cord connector includes both male and female contacts. The device includes a housing of electrically non-conductive material including a cylindrical cavity. A pair of opposed plungers are mounted for reciprocation in this cavity. An actuator switch in the form of an elliptical disc is mounted for reciprocation in the housing about a center shaft between the plungers. Each plunger is biased into engagement with the outer cam edge of the disc by means of springs. In use, the male connector of another electrical appliance is connected with the female connector of the device. The female end of a second electrical appliance is connected with the male connector of the device. The actuator switch is then turned so that the plungers are forced outwardly against the biasing of the springs. This causes spring metal conducting members in both the female and male connectors or contacts to bow outwardly and press against the cooperating male and female connectors of the other appliances so as to positively hold all the connectors together.

12 Claims, 2 Drawing Sheets

10
36
28
45
12

10
40
42
24
12
20
44
34
28
44
38
22
22
31
30
18
44
28
42
26
14
20
16
24
26

42
44
44
40
36
28
38
36
31
34
28
42

LOCKING ELECTRICAL CORD CONNECTOR

This is a continuation of application Ser. No. 07/482,075, filed Feb. 16, 1990, abandoned.

TECHNICAL FIELD

The present invention relates generally to electrical connectors and, more particularly, to a locking electrical cord connector that securely attaches at both the male and female ends.

BACKGROUND OF THE INVENTION

Nearly everyone at one time or another has experienced the inconvenience and frustration of having male and female electrical connectors become disengaged while attempting to operate a hand-manipulated electrical appliance. Housewives operating a vacuum cleaner often experience the male connector at the end of the vacuum cleaner cord coming disengaged from a cooperating female connector of an extension cord or from the wall outlet. As another example, carpenters operating drills and/or circular saws at a construction job site often experience this same difficulty. This can be particularly disruptive to the effective completion of work in the latter situation where long extension cords are often utilized and the individual may have to, for example, climb down a ladder to reengage the connectors an then climb back up the ladder to return to the work area.

In many situations, carpenters and other individuals have resorted to tying the adjacent ends of electrical cords together to prevent disengagement of the connectors. While this procedure does prevent disconnection of the male and female connectors, it is not a very effective solution to the problem for a number of reasons. First, it is a relatively time consuming procedure. Second, the strain placed upon the electrical conductors in the cord through this tying over time leads to damage which at the very least could render the cord useless and in certain situations could potentially lead to a dangerous direct short. Third, it should also be appreciated that this procedure is not possible where the electrical cord is plugged directly into a wall outlet. Fourth, this procedure does nothing to improve the electrical connection between the male and female connectors.

Recognizing these and other problems, various devices have been developed for maintaining male and female electrical connectors in a connected condition. For example, U.S. Pat. No. 4,784,612 to Ryan discloses a hollow capsule including cooperating male and female halves. The male and female electrical connectors to be held together are placed in the cooperating halves which are then threaded together to tightly press the connectors together. While this device is effective in holding male and female connectors of two cords together, it must be appreciated that the device is relatively cumbersome and time consuming to utilize. The device is also not effective in holding an electrical connector in a wall outlet. Additionally, the device does not effectively improve the electrical contact between the connectors.

Another locking electrical connector is disclosed in U.S. Pat. No. 4,626,681 to Hong. More particularly, the female contacts of the Hong patent each include a pair of moveable legs that may be wedged to press against a cooperating male contact and lock the two in a coupled position. While this device is effective in retaining male and female connectors together as well in improving the electrical contact between the connectors, it also suffers from a number of disadvantages. More particularly, the device does not include a locking male connector. Accordingly, the device is not in any way effective in retaining a male connector in a standard wall outlet: that is, not one constructed in accordance with the teachings of the Hong patent. Accordingly, the device disclosed in the Hong patent is of limited value to individuals using standard electrical outlets.

A need is therefore clearly identified for an improved electrical connector.

SUMMARY OF THE INVENTION

Accordingly, it is a primary object of the present invention to provide a locking electrical cord connector overcoming the above-described limitations and disadvantages of the prior art.

Another object of the present invention is to provide a locking electrical cord connector that positively holds cooperating male and female connectors together in a connected position so as to resist separation.

Another object of the present invention is to provide a locking electrical cord connector that not only positively holds cooperating male and female connectors together but also improves the electrical contact between the connectors.

Yet another object of the present invention is to provide a locking female electrical connector of relatively simple construction that may be conveniently operated to positively hold a cooperating male connector of an electrical appliance.

Yet another object of the present invention is to provide a locking male electrical connector of relatively simple construction that may be utilized to reliably engage and resist separation from a cooperating female connector of an electrical appliance such as a wall outlet.

Additional objects, advantages, and other novel features of the invention will be set forth in part in the description that follows and in part will become apparent those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as describe herein, an improved locking electrical cord connector is provided. The locking electrical cord connector includes a housing of electrically non-conductive material. Both male and female electrical contacts are provided in the housing. Additionally, means are provided for locking the male and female contacts to cooperating contacts in other electrical appliances such as extension cords, cords on electrical equipment and wall outlets. Further, the apparatus includes means for actuating the locking means between unlocked and locked positions. In the unlocked position the male and female electrical contacts may be easily connected and disconnected from cooperating contacts of other electrical appliances. In the locked position, the male and female contacts positively hold the cooperating male and female contacts of the other appliances with a tight interference fit. Thus, the contacts resist separation. This serves to allow the manipulation of various hand-operated tools such as, for example, vacuum cleaners, circular saws, and drills while significantly reducing or eliminating the tendency of the contacts to separate during this manipulation. In this way electrical power to the appliances is ensured.

Preferably, the housing includes a central cavity. The actuating means is a finger actuated elliptical disc mounted for reciprocation in the central cavity about a shaft.

A pair of opposed, displaceable plungers are received in the cavity. A biasing means in the form of coil springs biases the plungers into engagement with the peripheral edge of the actuating disc. Accordingly, the elliptical disc may be rotated to control the movement of the plungers against the springs in the cavity.

Each of the male and female contacts include spring metal conductive members connected to the plungers. The plungers are operable in a first position to extend and straighten the spring metal conductive members. This serves to allow free connection of the male and female electrical contacts with cooperating contacts of various electrical appliances. The plungers are also operable in a second position to bow the spring metal conductive members so as to provide a positive interference fit between the male and female electrical contacts and the cooperating connectors of other electrical appliances.

More specifically, the female electrical contact includes a pair of conductive sockets for receiving the two prongs of a cooperating male electrical contact. Each socket includes a pair of opposed spring metal conductive members which bow together when in the locked position tightly to clamp the prongs. When in the unlocked position, the opposing spring metal conductive members straighten to provide the necessary clearance to allow the free connection/disconnection of the cooperating contacts.

The male electrical contact includes a pair of prongs for engaging a pair of sockets of a cooperating female electrical contact. Each prong includes a pair of opposed spring metal conductive members. In the unlocked position, the spring metal conductive members extend straight alongside the prongs to provide the necessary thin profile to allow free connection/disconnection with cooperating female contacts. In the locked position, the spring metal conductive members bow outwardly away from the prong to securely engage the female contacts and provide a tight positive fit. Where additional gripping action is desired the spring metal conductive members may include a means for gripping the cooperating contacts of the other electrical appliances. In a preferred embodiment the gripping means is a series of ridges that are etched, stamped or in some other way imprinted on the spring metal conductive members. These ridges serve to increase the frictional force holding the contacts together.

Still more particularly, the distal end of each spring metal conductive member of the male contacts is fixed to the associated prong. Similarly, the distal end of each spring metal conductive member of each female contact is fixed to the associated socket. The proximal end of each spring metal conductive member is attached to one of the plungers which is formed of electrically non-conductive material. A guide sleeve is provided adjacent a proximal end of each prong and socket to slidably receive the spring metal conductive member cooperating with that prong or socket and hold it in proper alignment along the prong or socket.

In accordance with the further aspects of the present invention, the locking male electrical connector as well as the locking female electrical connector are independently claimed. Additionally, it should be appreciated that an electrical conductor is provided to electrically connect the locking male and female electrical connectors in line. Where the locking male and female electrical connectors are provided in the same housing, the conductor may take the form of wiring mounted in the side of the housing. Alternatively, it should be appreciated that the locking male and female electrical connectors may be provided in separate housings with one housing provided at each end of an extension cord including appropriate electrical conductors.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification illustrates several aspects of the present invention, and together with the description serves to explain the principles of the invention. In the drawing.

Referencing will now be made in detail to the present preferred embodiment of the invention, an example of which is illustrated in the accompanying drawing.

DETAILED DESCRIPTION OF THE INVENTION

Figure 1:
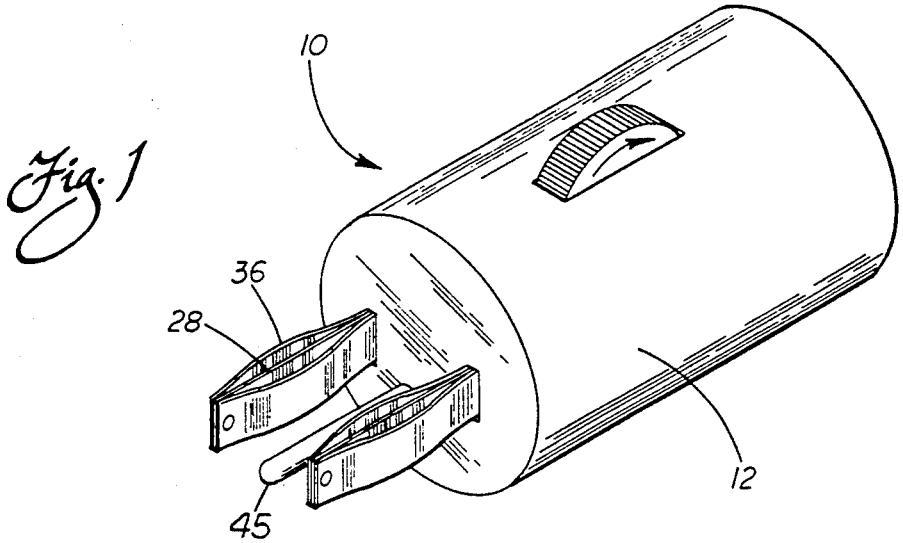
FIG. 1 is a perspective view of a locking electrical cord connector constructed in accordance with the teachings of the present invention.
Figure 2:
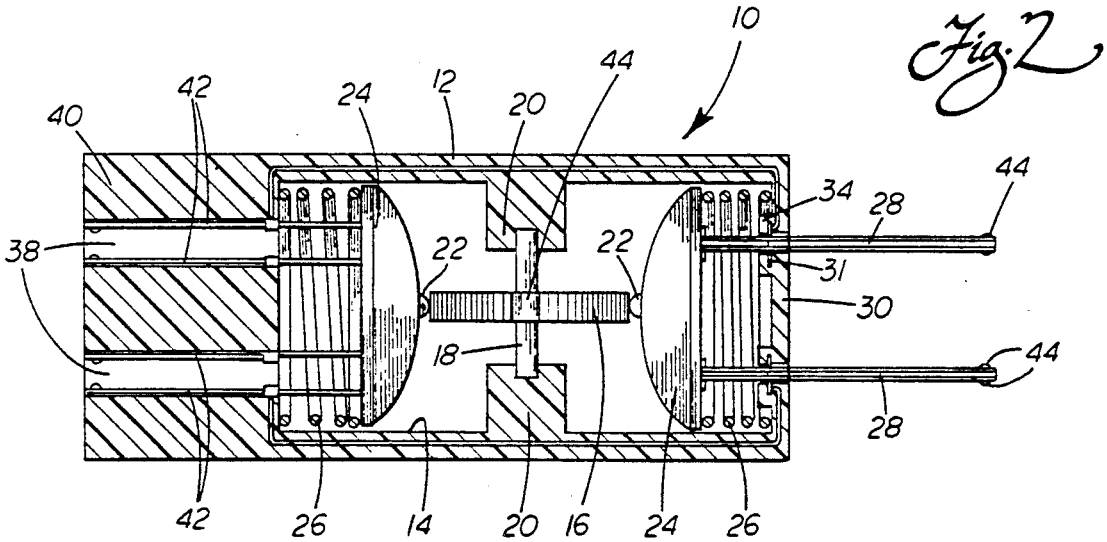
FIG. 2 is a cross-sectional view of the locking electrical cord connector shown in FIG. 1 in the unlocked position to allow simple connection and disconnection with cooperating connectors of other electrical appliances.
Figure 3:
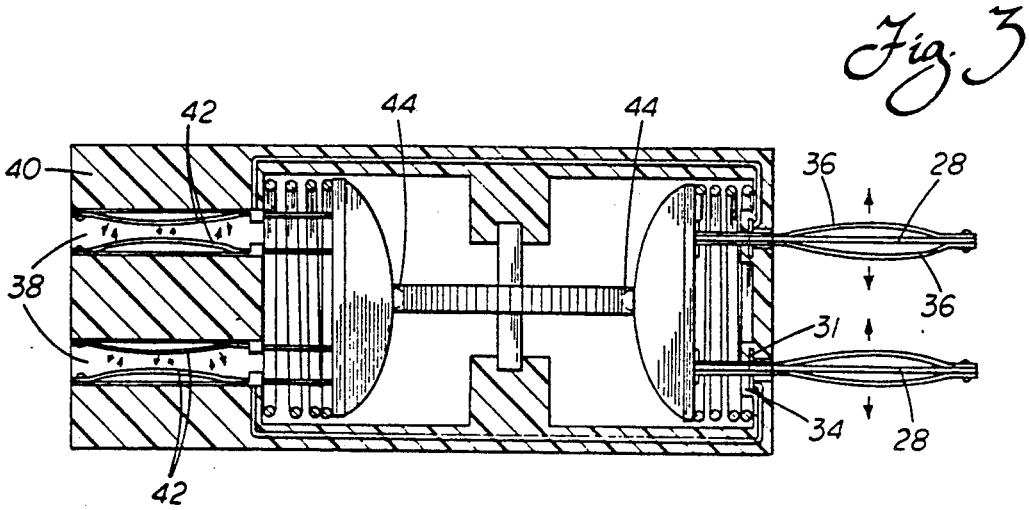
FIG. 3 is a cross-sectional view similar to FIG. 2 but showing the locking electrical cord connector in the locked position.

Reference is now made to FIGS. 1–3 showing the improved locking electrical cord connector 10 of the present invention. As best shown in FIG. 1, the cord connector 10 includes a housing 12. Preferably, the housing 12 is formed of electrically non-conductive material. For example, it may be molded of plastic such as ABS plastic. More specifically, it is anticipated that the housing 12 will be molded in separate upper and lower portions that are joined together after the other components of the electrical cord connector 10 are placed in their proper position as shown and described below.

Figure 7:
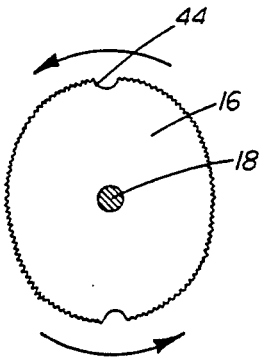
FIG. 7 is a partially sectional side elevational view of the finger actuated elliptical disc that is manipulated to lock and unlock the electrical cord connector of the present invention.

As best shown in FIGS. 2 and 3, the housing 12 includes a central cavity 14. A finger actuated elliptical disk 16 is mounted in this cavity (see also FIG. 7). The actuator disc 16 is mounted on a shaft 18 that is received in a pair of cooperating grooves in mounting blocks 20 molded into the housing 12. As shown, the outer peripheral edge of the actuator disc 16 is ribbed to allow positive frictional engagement with a finger so that the disk may be rotated about the shaft 18 to lock and unlock the electrical connector 10 as described in greater detail below.

The outer peripheral edge of the actuator disc 16 acts as a camming surface. More particularly as shown in FIGS. 2 and 3, the outer peripheral edge of the actuator disc 16 engages a pair of cam followers 22. Each cam follower 22 is mounted to a single plunger 24. The two plungers 24 are opposed with one plunger mounted for reciprocation in each half of the central cavity 14. A pair of coil springs 26 are provided between each plunger 24 and the adjacent end wall of the central cavity 14 so as to bias the plungers into engagement with the peripheral camming edge of the actuator disc 16.

A pair of electrically conducting prongs 28 extend outwardly from an end wall 30 of the cord connector 10. The prongs 28 are fixed to the interior of the end wall 30 by any appropriate means. For example, the prongs 28 may include a downwardly extending lug 31 that tightly engages a slot in the mounting block 34.

Figure 4:
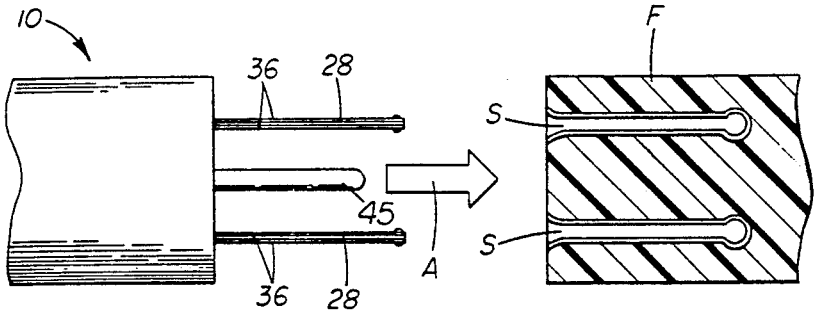
FIG. 4 is a schematic representation showing the coupling of a locking male electrical connector with a standard female connector.
Figure 4A:
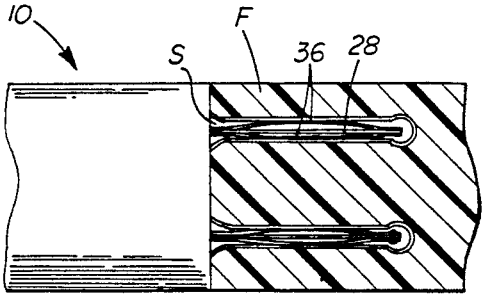
FIG. 4*a* shows the connectors of FIG. 4 connected and locked together.

A pair of opposed spring metal conductive members 36 (i.e. first lacking means) are mounted to opposite sides of each prong 28. Together, the conductive members 36 and prong 28 form the male electrical contact. As shown, the distal ends of each opposed spring metal conductive member 36 is riveted to the associated prong 28 adjacent its distal end. The proximal end of each spring metal conductive member 36 is fixed or riveted to the adjacent plunger 24 (note plunger shown on right in FIGS. 2 and 3). As described in greater detail below, the spring metal conductive members 36 are designed to straighten and lay flat against the prongs 28 when the cord connector 10 is in the unlocked position (note FIG. 2). In contrast, when in the locked position shown in FIG. 3, the spring metal conductive members 36 are manufactured to bow outwardly from the prong 28 about a median portion thereof to provide a tight interference fit with a cooperating female connector or contact of another electrical appliance as shown in FIG. 4*a*.

At the opposite end of the cord connector 10 a pair of electrically conductive sockets 38 are provided in the end wall 40. A pair of opposed spring metal conductive members 42 (i.e. second lacking means) are mounted in each of the sockets 38. Together, the sockets 38 and spring metal conductive members 42 form the female contact. As shown, the spring metal conductive members 42 are riveted to the electrically conductive socket 38 adjacent their distal ends. The proximal end of the spring metal conductive elements 42 are fixed or riveted to the face of the adjacent plunger 24 (note the plunger shown on the left in FIGS. 2 and 3). As with the spring metal conductive elements 36 discussed above with respect to the male electrical contact, the spring metal conductive elements 42 straighten alongside the opposing walls of the socket 38 when the connector 10 is in the unlocked position (note FIG. 2). In contrast, when in the locked position shown in FIG. 3, the spring metal conductive elements 42 bow outwardly from the walls of the socket and in toward one another. In this way, the female electrical contact provides a tight interference fit with a cooperating male contact or connector of another electrical appliance as shown in FIG. 5*a*.

A pair of electrical conductors 43 are provided in grooves in the housing 12 to connect the male and female contacts of the same polarity together. Of course, it should be also appreciated that the male and female connectors could be provided in different housings and that the conductors would then be provided in a long cord electrically connecting those housings and their contacts together.

As shown in FIG. 1, the connector 10 also includes a ground terminal 45 at the male end and a ground terminal receiving socket (not shown) at the female end. The ground terminal 45 and ground terminal receiving socket are electrically connected together by a conductor (not shown). This ground conductor is provided in the wall of the housing 12 in a similar manner to the conductors 43 described above.

Actuation of the cord connector 10 between the locked and unlocked positions is accomplished through manipulation of the actuator disc 16. The operation of the cord connector 10 will now be described in detail.

It should be appreciated, the cord connector 10 of the present invention is particularly adapted for connecting electrical appliances together in a secure manner. The device may, for example, be utilized to connect a pair of extension cords together, to connect an extension cord or a cord from another electrical appliance such as a circular saw or drill to a wall outlet or in any other appropriate manner. The cord connector 10 is connected to cooperating connectors of other electrical appliances by first placing it in the unlocked position shown in FIG. 2. This is done by rotating the elliptical actuator disc 16 so that the minor axis extends between the cam followers 22 on the plungers 24. In this position, the spring metal conductive members 36 straighten and rest directly alongside the prongs 28 in a relatively thin profile. Accordingly, the male contact of the electrical cord connector 10 may be easily connected to a cooperating female connector F of another electrical appliance by simply pushing the prongs 28 down into the prong receiving sockets S in the direction of action arrow A.

Figure 5:
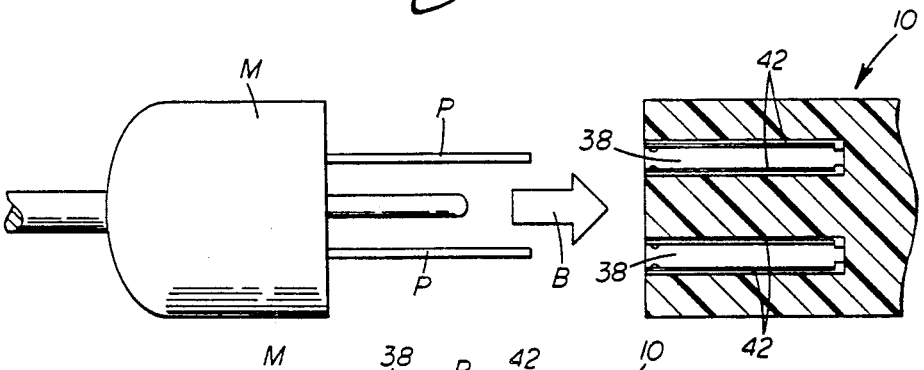
FIG. 5 is a schematic representation showing the coupling of a standard male electrical connector with a locking female connector.
Figure 5A:
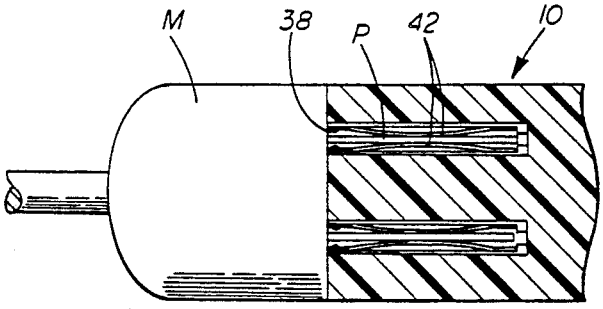
FIG. 5*a* is a schematic representation showing the connectors of FIG. 5 connected and locked together.

Similarly, in the unlocked position the spring metal conductive members 42 are straightened and lie alongside the walls of the socket 38 (note FIG. 5). Accordingly, the sockets 38 are left open to provide the necessary clearance to freely receive the prongs P of a male electrical connector M from another electrical appliance. Accordingly, the prongs P slide freely in the direction of action arrow B into the sockets 38 so as to provide connection.

Once the electrical cord connector 10 is connected at the male and female ends in the manner shown in FIGS. 4*a* and 5*a*, the elliptical actuator disc 16 is rotated with the finger so as to bring the major axis of the disc into engagement with the cam followers 22 of the plungers 24. This serves to extend the plungers 24 outwardly against the coil springs 26. As this occurs, the proximal ends of the spring metal conductive members 36, 42 connected to the plungers 24 move outwardly toward the distal ends fixed to the distal ends of the prongs 28 and walls of the sockets 38. Accordingly, the spring metal conductive members 36, 42 slide through the fixed guide sleeves 46 and in accordance with their prestressing bow outwardly as shown by the action arrows in FIG. 3. Thus, as shown in FIG. 4*a*, the spring metal conductive members 36 on the prongs 28 serve to positively engage the conducting walls of the sockets S of the cooperating female connector F of an electrical appliance. In this way a secure positive interference fit is provided with appropriate force to improve the electrical connection between the two members. Similarly, the opposed spring metal conductive members 42 bow outwardly to tightly engage and grip the prongs P of a cooperating male electrical connector M as shown in FIG. 5*a*. Again, a tight interference fit is provided with improved contact between the two connectors.

Figure 6:
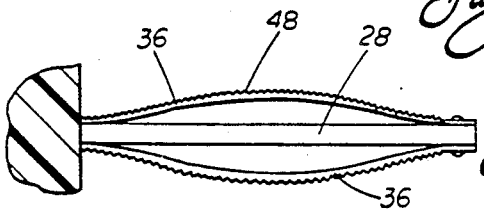
FIG. 6 is a detailed, partially sectional, plan view showing the gripping ridges provided on the spring metal conductive members of a locking male electrical connector of this invention.

In order to further increase gripping power the spring metal conductive members 36 and 42 may be imprinted or embossed with ridges 48. Such ridges 48 are shown, for example, on the spring metal conductive members 36 in FIG. 6. These ridges serve to "bite" into the cooperating male and female contacts and provide significantly increased frictional engagement for better and more secure connection and improved electrical contact.

Additionally, it should be appreciated that a pair of opposed notches 44 are provided in the peripheral edge of the elliptical actuator disc 16 in line with the major axis thereof. When manipulated to be in the locked position, the cam followers 22 on the plungers 24 snap into these notches 44 to insure that the connector 10 is not inadvertently released from the locked position. When it is desired to release the connector 10, the snap action lock provided by the notches 44 and cam followers 22 may, however, be overcome by application of sufficient force on the disc 16 with the finger to turn the actuator disc to the unlocked position.

In summary, numerous benefits have been described which result from employing the concepts of the present invention. Advantageously, the locking electrical cord connector 10 provides secure tight engagement with cooperating connectors of other electrical appliances. By also providing a locking male connector, the device may even be utilized to lock into a standard wall outlet. This represents a significant advantage over prior art designs. The device is easily operated through the simple actuation of a disk 16 with the fingers or thumb. Additionally, the device is of relatively simple construction so as to be relatively inexpensive to produce and to provide excellent reliability.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A locking electrical cord connector, comprising:

housing means of electrically non-conductive material including a central cavity;

a male electrical contact on said housing means;

a female electrical contact on said housing means;

first means cooperating with said male electrical contact for locking said male contract to a female connector of another electrical appliance;

second mass cooperating with said female electrical contact for locking said female contact to a male connector of another electrical appliance, said first and second locking means being fully functional independent of one another;

means for actuating said first and second locking means mounted for reciprocation in said housing means; and a pair of opposed plungers in said cavity, said actuating means engaging said plungers to control the movement thereof in said cavity;

said male and female contacts each including at least one spring metal conductive member connected to one of said plungers, said plungers operable in a first position to extend said spring metal conductive members and allow free connection of said male and female electrical contacts; and said plungers operable in a second position to bow said spring metal conductive members and thereby provide a positive interference fit between said male and female electrical contacts and said connectors of other electrical appliances.

2. The locking electrical cord connector set forth in claim 1, further including biasing means to bias said plungers into engagement with said actuating means.

3. The locking electrical cord connector set forth in claim 1, wherein said spring metal conductive members include means for gripping said connectors of other electrical appliances, said gripping means including a series of ridges imprinted on said spring metal conductive members.

4. The locking electrical cord connector set forth in claim 1, wherein a guide sleeve is provided at a proximal end of at least one of said contacts to slidably receive said spring metal conductive member of said contact and hold said spring metal conductive member in proper alignment.

5. The locking electrical cord connector set forth in claim 1, wherein said actuating means includes notch means for positively holding said plungers in said second position.

6. The locking electrical cord connector set forth in claim 1, wherein said female electrical contact includes a pair of sockets for receiving a pair of prongs of a cooperating male connector of another electrical appliance, each socket including at least one opposed spring metal conductive member which bows to tightly clamp one of said prongs and positively hold said female electrical contact and male connector of another electrical appliance together.

7. The locking electrical cord connector set forth in claim 6, wherein a distal end of said at least one spring metal conductive member of said female electrical contact is fixed to said sockets and a proximal end is attached to one of said plungers formed of electrically non-conductive material.

8. The locking electrical cord connector set forth in claim 1, wherein said male electrical contact includes a pair of prongs for engaging a pair of sockets of a female connector of another electrical appliance at least one of said prongs including at least one spring metal conductive member that bows outwardly away from said prong to engage one of said sockets and tightly hold said male electrical contact and female connector of another electrical appliance together.

9. The locking electrical cord connector set forth in claim 8, wherein a distal end of said at least one spring metal conductive member of said male electrical contact is fixed to said prongs and a proximal end is attached to one of said plungers formed of electrically non-conductive material.

10. A locking male electrical connector, comprising:

a housing of electrically non-conductive material;

a pair of electrically conducting prongs;

at least one spring metal conductive member mounted to and aligned along at least one prong by means of a guide sleeve at a proximal end; and means for actuating said spring metal conductive member between a first position wherein said spring metal conductive member is extended to allow free connection with a cooperating female conductor of another electrical appliance and a second position wherein said spring metal conductive member is bowed outwardly away from said at least one prong to provide a tight interference fit with a cooperating female connector of another electrical appliance to thereby positively hold said connectors operatively together.

11. The locking male electrical connector set forth in claim 10, wherein said at least one spring metal conductive member is fixed to said at least one prong at a distal end.

12. The locking male electrical connector set forth in claim 10, wherein said at least one spring metal conductive member includes imprinted ridges for gripping said cooperating female connector.

* * * * *